US007482548B2

(12) United States Patent
Periot et al.

(10) Patent No.: US 7,482,548 B2
(45) Date of Patent: Jan. 27, 2009

(54) EXTENDED ACTUATING DEVICE FOR A CIRCUIT BREAKER INCLUDING A TRIP ASSISTANCE DEVICE

(75) Inventors: Jean-Marie Periot, Rueil Malmaison (FR); Evans C. K Er, Singapore (SG); Thian Nguan Quah, Singapore (SG)

(73) Assignee: Schneider Electric Industries SAS, Rueil-Malmaison (FR)

( * ) Notice: Subject to any disclaimer, the term of this patent is extended or adjusted under 35 U.S.C. 154(b) by 0 days.

(21) Appl. No.: 11/877,993

(22) Filed: Oct. 24, 2007

(65) Prior Publication Data

US 2008/0135389 A1 Jun. 12, 2008

(30) Foreign Application Priority Data

Nov. 2, 2006 (FR) ..... 06 54696

(51) Int. Cl.
*H01H 5/00* (2006.01)

(52) U.S. Cl. ..... 200/400; 200/330; 200/336; 200/43.08

(58) Field of Classification Search ..... 200/400, 200/336, 330–331, 50.01, 50.11, 50.17, 50.23, 200/50.24, 43.08, 43.11
See application file for complete search history.

(56) References Cited

U.S. PATENT DOCUMENTS

| | | | | |
|---|---|---|---|---|
| 3,313,896 | A | 4/1967 | Gray | |
| 5,493,084 | A * | 2/1996 | Whitaker et al. | 200/50.05 |
| 6,423,912 | B1 * | 7/2002 | Arenz et al. | 200/43.08 |
| 6,606,229 | B2 * | 8/2003 | Takahashi et al. | 361/115 |
| 6,797,903 | B1 | 9/2004 | Winslett et al. | |

FOREIGN PATENT DOCUMENTS

EP 1 583 120 A1 10/2005

* cited by examiner

*Primary Examiner*—Kyung Lee
(74) *Attorney, Agent, or Firm*—Oblon, Spivak, McClelland, Maier & Neustadt, P.C.

(57) ABSTRACT

An extended actuating device for a circuit breaker is provided, including a trip assistance device having a first rotary device integral in rotation with a control lever of the circuit breaker. A second rotary device is integral in rotation with a remote control device. The second rotary device is able to be driven in rotation by the first rotary device as far as a first position corresponding to the tripped position of the lever of the circuit breaker. A return spring is provided to force the second rotary device towards its first position. A breakable mechanical link device releases the return spring when its breakable mechanical link is broken.

13 Claims, 13 Drawing Sheets

Figure 1A:
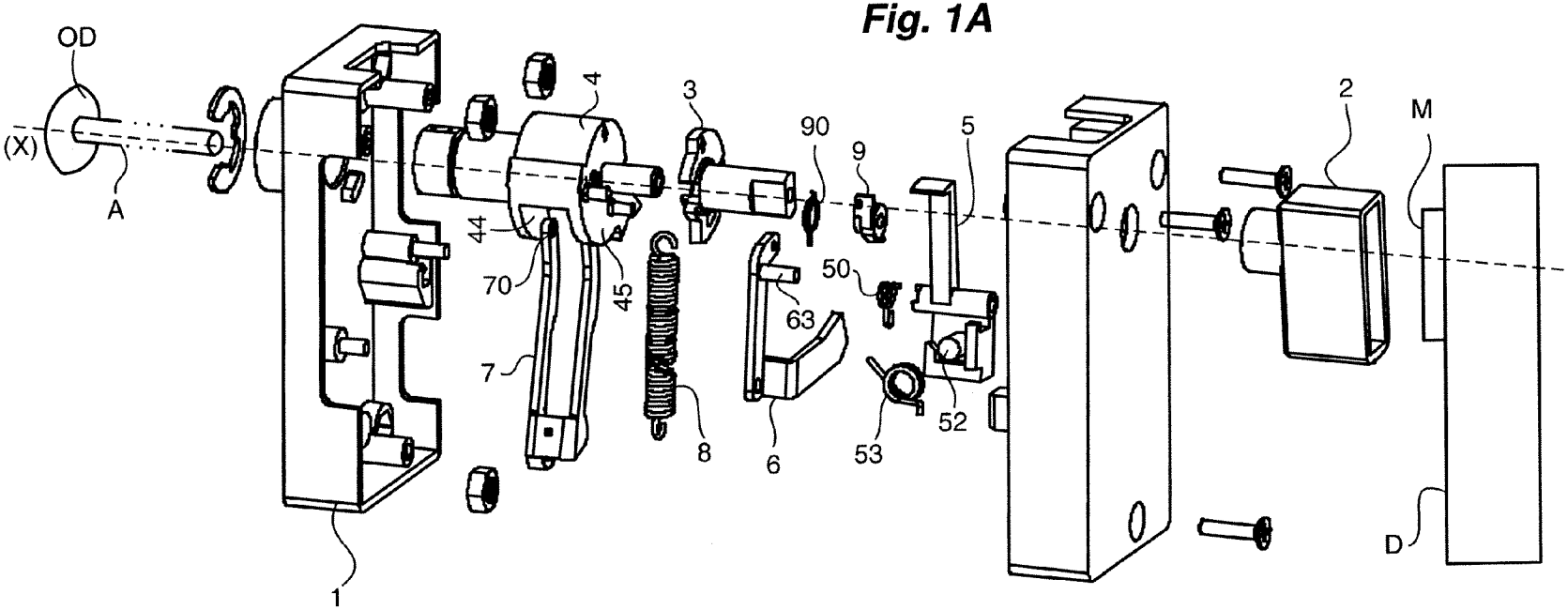

Fig. 3
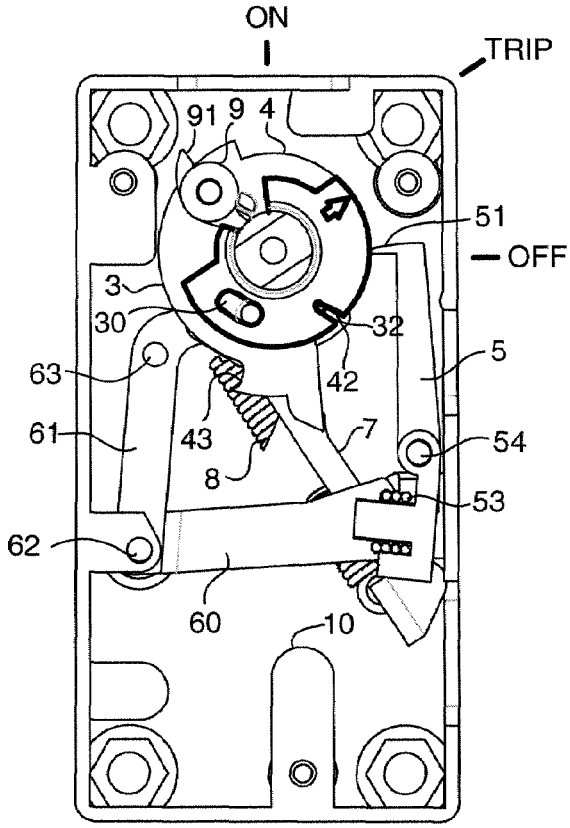
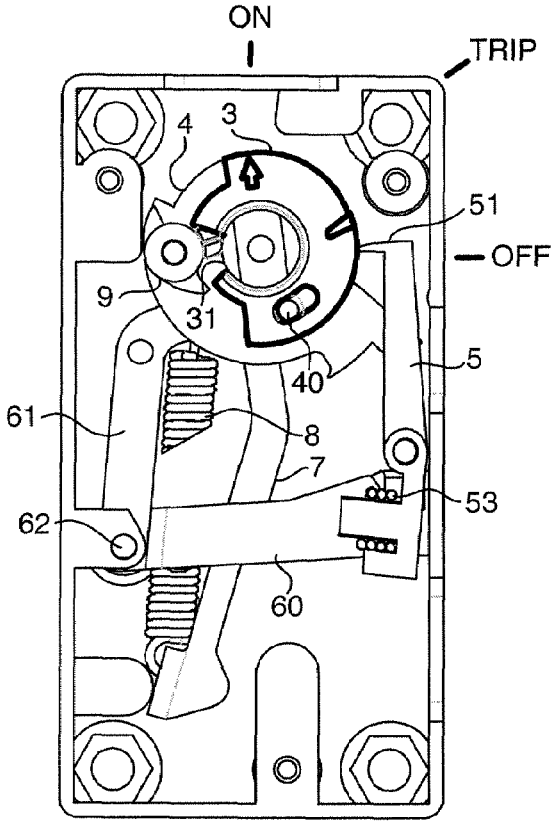
Fig. 4A

Fig. 8
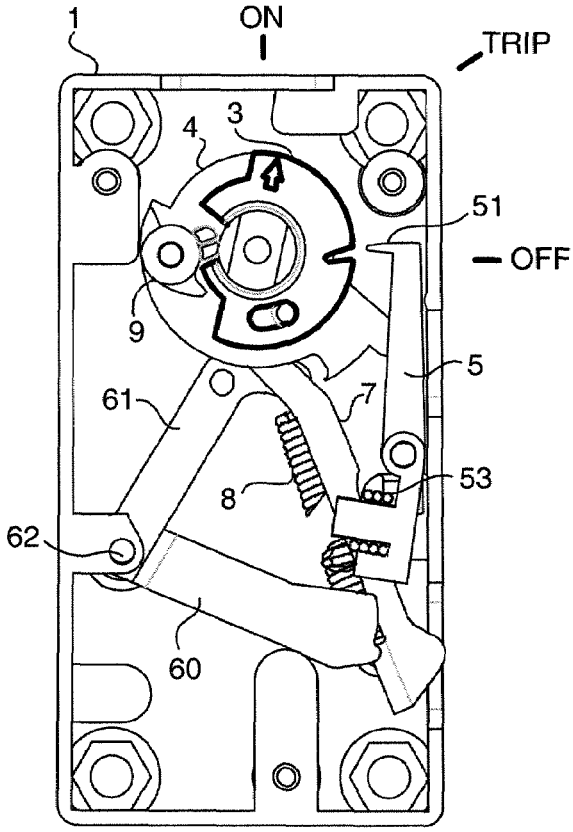
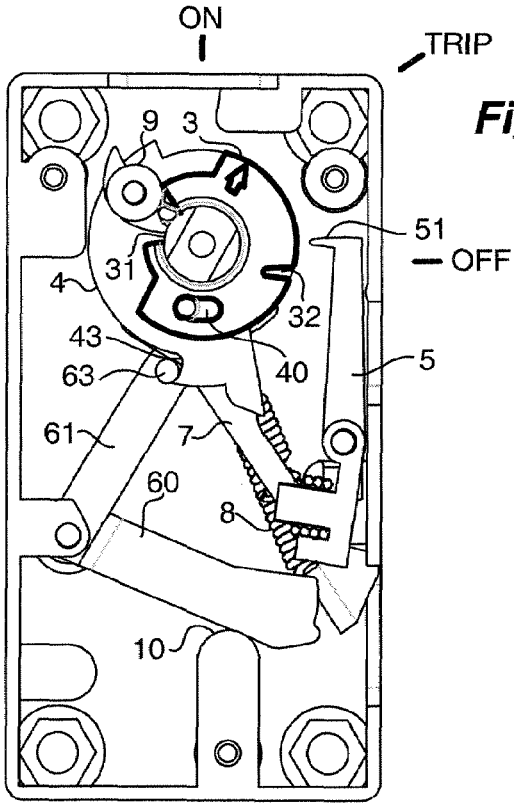
Fig. 9

EXTENDED ACTUATING DEVICE FOR A CIRCUIT BREAKER INCLUDING A TRIP ASSISTANCE DEVICE

The present invention relates to an extended actuating device for an electrical switch device.

An extended actuating device makes it possible to remote control an electrical device, such as a circuit breaker for example, by means of a mechanical link. A device of this type is for example described in the U.S. Pat. No. 6,797,903.

An extended actuating device comprises, for example, a remote control device mounted on the door of an enclosure and mechanically connected to a lever of the electrical device which is placed in the enclosure. The electrical device can thus be controlled without having to open the enclosure, which makes it possible, in particular, to enhance safety. In a conventional circuit breaker with a rotary lever, the lever can assume three separate positions, an on position in which it is vertical, an off position situated 90° from the on position or a tripped position situated midway between the on position and the off position. The tripped position is assumed by the lever when a current overload or short circuit is detected by a protection device of the circuit breaker.

An extended actuating device typically comprises a remote control device of the same type as the rotary lever of the circuit breaker. This control device is operated manually and is mechanically connected to the lever of the circuit breaker by the intermediary of a transmission shaft for remotely controlling the circuit breaker. The angular position of the remote control device indicates to the user the position of the lever of the circuit breaker present in the enclosure.

An extended actuating device operates according to two different modes:

- in a first operating mode, the movement of the remote control device is a driving movement. In this case, the operator causes a movement of the lever of the circuit breaker by the intermediary of the transmission shaft by turning the remote control device,
- in a second operating mode, the movement of the lever of the circuit breaker is a driving movement. This occurs when the circuit breaker is tripped following a current overload or a short circuit. In this case, the lever automatically moves from the on position to the tripped position and it drives the transmission shaft. The remote control device follows the movement imparted by the lever and positions itself in a position corresponding to the tripped position of the lever.

In this second operating mode, the rotary lever must therefore produce a large force in order to independently drive the transmission shaft and to transmit its rotational movement to the remote control device.

The purpose of the invention is to propose an extended actuating device in which, in the case of tripping, the rotational movement of the rotary lever is transmitted to the remote control device without excessive force, thus making it possible to guarantee reliable and durable functioning of the extended actuating device.

This purpose is achieved by an extended actuating device for a circuit breaker, characterized in that it comprises a trip assistance device comprising:

- a body,
- a first rotary device integral in rotation with a control lever of the circuit breaker, the said lever being able to assume, by rotation about a principal axis, several offset angular positions, an on position, an off position or a tripped position according to the on, off or tripped status of the circuit breaker,

- a second rotary device integral in rotation with a remote control device able to assume several offset angular positions corresponding to the positions of the lever of the circuit breaker, the said second rotary device being able to be driven in rotation by the first rotary device as far as a first position corresponding to the tripped position of the lever of the circuit breaker,
- a return spring tending to force the second rotary device towards its first position,
- a breakable mechanical link device able to release the return spring when the breakable mechanical link is broken,
- the breakable mechanical link comprising a shape that is complementary to a shape of the first rotary device and to a shape of the second rotary device, the opposition of the shape of the breakable mechanical link and the shapes of the first and second rotary devices resulting in the breaking of the mechanical link of the breakable mechanical link device.

According to one feature, the breakable mechanical link device is composed of a part pivoting about the principal axis and a lever pivoting about the principal axis.

According to another feature, the pivoting lever has a pin against which the pivoting part forming the breakable mechanical link of the breakable mechanical link device bears.

According to another feature, the pin is constituted by a spur of a torsion spring mounted on the pivoting lever about an axis perpendicular to the principal axis.

According to another feature, the pivoting part comprises, on either side of its axis of rotation, two arms that are rigidly connected and angularly offset.

According to another feature, one of the two arms of the pivoting part comprises a stop for the second rotary device when the latter is in its first position.

According to another feature, rotational force is applied to the pivoting lever by a torsion spring.

According to another feature, the trip assistance device comprises a stabilizer articulated at a first end on the second rotary device, its axis of articulation being parallel with the principal axis and offset with respect to the latter.

According to another feature, the return spring is fixed on the one hand on the pivoting part and on the other hand on the second end of the stabilizer.

According to another feature, the trip assistance device comprises a travel amplifying device rotationally mounted on the second rotary device about an axis parallel with the principal axis and acted upon by a torsion spring, this device being able to cooperate with, on the one hand, a stop of the body and, on the other hand, with the first rotary device in order to amplify its travel.

According to another feature the amplifying device comprises two radial protuberances, an outer protuberance able to butt against the body and an inner protuberance cooperating with a groove formed on the first rotary device.

According to another feature, the shape of the breakable mechanical link device is produced on the pivoting lever and is constituted by a hook-shaped head and the first rotary device and the second rotary device each comprise an orifice which, when they are aligned, form a groove able to receive the head of the lever.

According to another feature, the first rotary device and the second rotary device are integral in rotation, one of them having a degree of freedom with respect to the other.

Figure 1B:
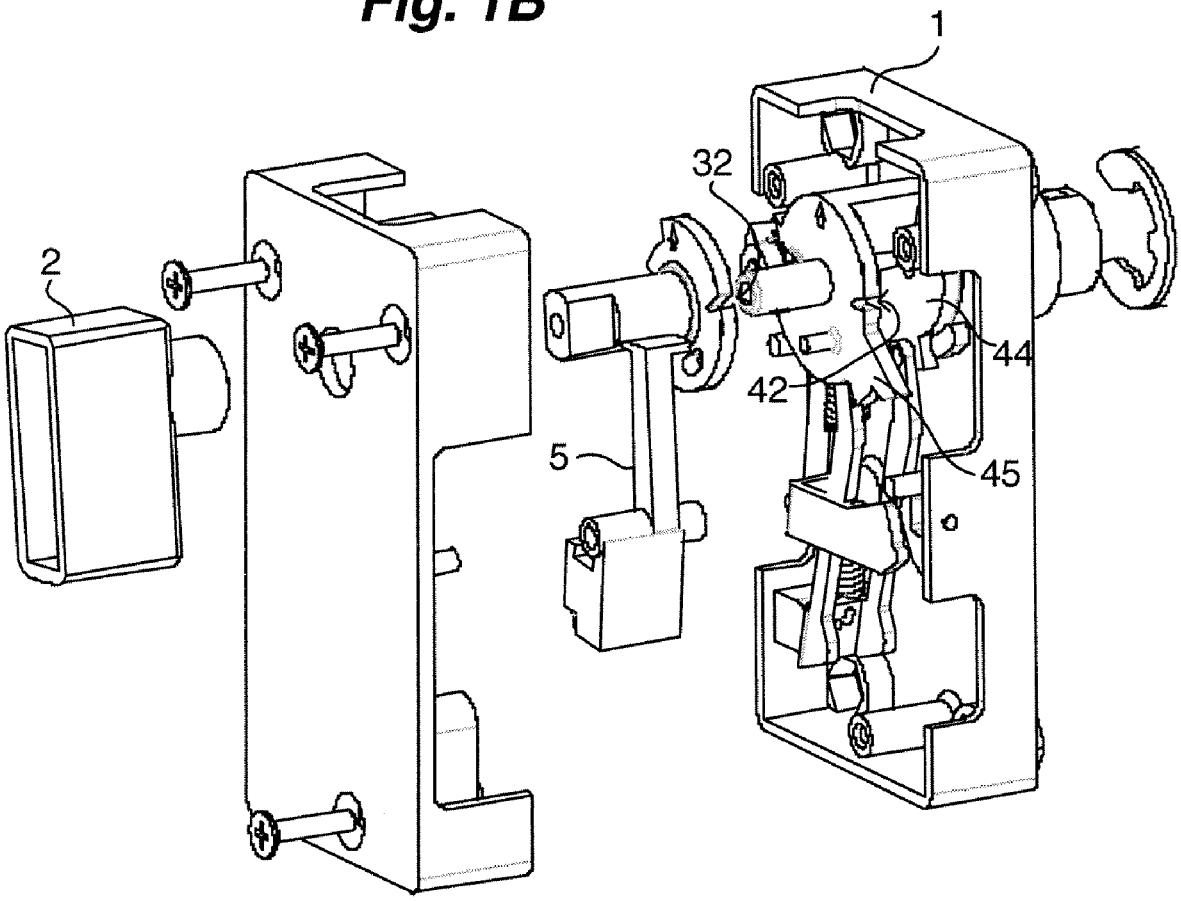

Other features and advantages will appear in the following detailed description referring to an embodiment given by way of example and shown in the appended drawings in which:

FIG. 1A is an exploded view of the extended actuating device according to the invention, FIG. 1B shows the trip assistance device according to the invention used in the extended actuating device, FIGS. 2A to 12B illustrate the operation of the trip assistance device.

In the text below, the references to the clockwise direction and the clockwise direction are defined in FIG. 2A by the arrows referenced h and ah respectively.

In FIGS. 2A, 3, 4A, 4B, 5, 6A, 7A, 8, 9, 10A, 11A and 12A, the trip assistance device is shown from the controlled circuit breaker.

In some of the appended figures, the return spring 8 is partially shown. These figures must be understood to include the return spring in its totality.

As described above, an extended actuating device (FIG. 1A) comprises a remote control device OD making it possible, by mechanical linkage, to remote control an electrical switching device such as for example a circuit breaker D. The circuit breaker D is for example placed in an enclosure and the remote control device OD is mounted on the door of the enclosure and is mechanically connected to the rotary lever M of the circuit breaker D for example by the intermediary of a transmission shaft A. An operator can therefore control the circuit breaker D directly from the outside, without opening the enclosure.

It is known that a circuit breaker D can be in an on state (ON), in an off state (OFF) or in a tripped state (TRIP). The state of the circuit breaker D is indicated by the angular position of its rotary lever M. This rotary lever M can therefore assume three separate and offset angular positions by rotating about a principal axis (X), an on position (ON) corresponding to the on state of the circuit breaker, an off position (OFF) corresponding to the off state of the circuit breaker and a tripped position (TRIP) corresponding to the tripped state of the circuit breaker D.

The on (ON) and off (OFF) positions are controlled by the operator either directly by operating the lever M of the circuit breaker D or by the intermediary of the extended actuating device, if such a device is used. By turning the remote control device OD, the operator remotely operates the rotary lever M of the circuit breaker D and confers upon the circuit breaker D in its on state or its off state. In this first operating mode, the remote control device OD is therefore a driving device since it drives the rotary lever M of the circuit breaker D.

In a second operating mode, the movement of the rotary lever M of the circuit breaker D drives the remote control device OD and is therefore a driver. In this operating mode, after the detection of a current overload or of a short circuit, the circuit breaker D changes to the tripped state (TRIP), automatically driving its lever into the tripped position (TRIP).

The remote control device OD can therefore assume three offset angular positions, on (ON), off (OFF) and tripped (TRIP), which are images of those assumed by the lever M of the circuit breaker D.

According to the invention, in order to assist the extended actuating device and to limit the stress applied on the transmission shaft during a tripping of the circuit breaker D, the extended actuating device comprises a trip assistance device (FIG. 1B).

The trip assistance device shown in the appended figures is intended to be mounted directly on a circuit breaker D (FIG. 1A).

It comprises a casing 1 on the outside of which is mounted, in a rotational manner, an end-piece 2 intended to fit directly on the rotary lever M of the circuit breaker D.

The trip assistance device also comprises a first rotary device 3 fitted to this end-piece 2 in such a way as to be integral in rotation with the end-piece 2 and therefore with the rotary lever M of the circuit breaker D.

The trip assistance device furthermore comprises a second rotary device 4 fitted into the first rotary device 3. The first rotary device 3 and the second rotary device 4 are linked in rotation in such a way as to leave play between each other. The second rotary device 4 comprises, for example, a tenon 40 whose end is housed in an oblong hole 30 formed on the first rotary device 3.

The transmission shaft A of the extended actuating device is integral in rotation with the second rotary device 4 and extends outside of the casing 1, on the side opposite to that of the end-piece 2. The remote control device OD is mounted on the end of the transmission shaft A.

The trip assistance device furthermore comprises a breakable mechanical link device.

The breakable mechanical link device consists of a lever 5 mounted on the casing such that it pivots about an axis 54 parallel with the principal axis (X) and of a pivoting part 6 mounted in a rotational manner on the casing 1 of the device, about an axis parallel with the principal axis (X) and with the pivoting axis of the lever 5.

The pivoting part 6 extends on either side of its axis 62 by two separate arms 60, 61, rigidly connected and substantially perpendicular to each other, hereafter referred to as the first arm 60 and the second arm 61.

The lever 5 is mounted on a torsion spring 50, tending to make it pivot in the anticlockwise direction towards the two rotary devices. The lever 5 extends on one side of its axis 54 by a part terminated by a hook-shaped head 51 and on the other side of its axis 54 by a part forming a stud 52 upon which is fitted a second torsion spring, hereafter called a retaining spring 53. The stud 52 is formed along an axis perpendicular to the pivoting axis 54 and parallel with the pivoting plane of the lever 5. The retaining spring 53 comprises a protruding spur 530 forming a pin against which the free end of the first arm 60 of the pivoting part 6 bears. At this end, the pivoting part 6 has a pin 600 able to come into contact with the protruding spur 530 of the retaining spring 53. The protruding spur 530 of the retaining spring 53 can be retracted by pivoting when it is subjected to a force applied in the anticlockwise direction and remains in a horizontal stopped position when it is subjected to a force applied in the clockwise direction.

Figure 2A:
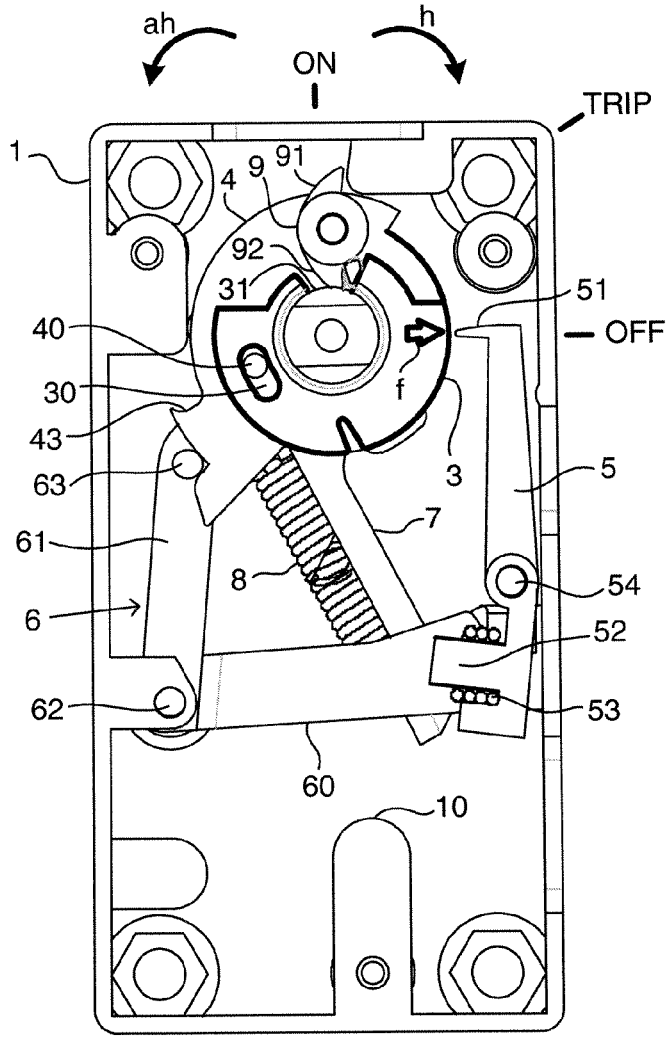
Figure 2B:
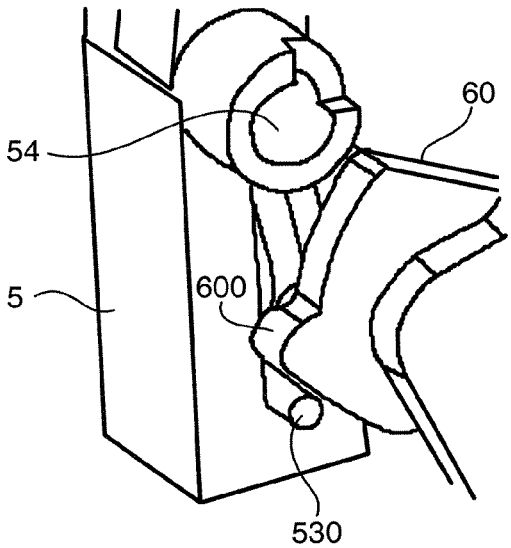
Figure 2C:
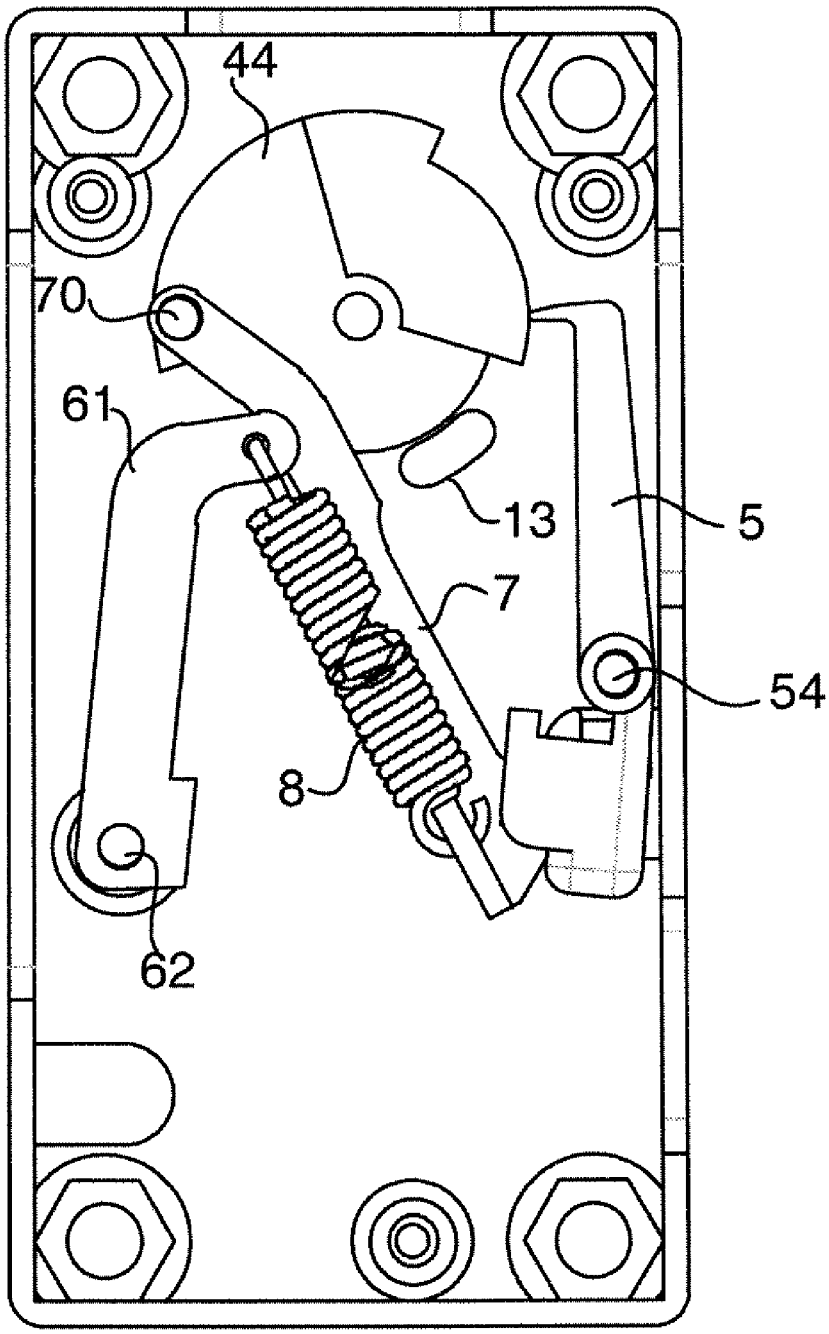

The trip assistance device comprises a stabilizer 7 composed of a rocker articulated at a first end on the second rotary device 4 about an axis 70 which is offset with respect to the principal axis (X) (FIGS. 1A and 2C). FIGS. 2C and 4C show a rear disk 44 of the second rotary device 4 upon which the articulation 70 of the stabilizer 7 is produced.

The trip assistance device comprises a helical return spring 8 fixed at one of its ends to the second end of the stabilizer 7 and at the other of its ends to the free end of the second arm 61 of the pivoting part 6. The stabilizer 7 therefore forms with the second rotary device 4 a knuckle-joint mechanism exhibiting a dead point. Moving from this dead point therefore involves the rocking of the stabilizer 7 which is thus able to assume two separate positions when the remote control device OD is in the off position (OFF) or in the on position (ON) respectively.

The trip assistance device comprises a travel amplification device 9 able to act on the rotational travel of the first rotary device 3. This device 9 is mounted such that it rotates about an axis parallel with the principal axis (X) on the second rotary device 4 and is acted upon about its axis by a torsion spring 90. This device 90 also comprises two radial protuberances 91, 92 allowing the amplification of the rotational travel of the first rotary device 3. In the rest position, one of the protuberances of the travel amplifying device, called the outer protuberance 91, is oriented towards the outside of the casing and protrudes with respect to the outer envelope of the second rotary device 4 whereas the other protuberance, called the inner protuberance 92, is lodged in a groove 31 formed on the first rotary device 3.

According to the invention, each of the two rotary devices 3, 4 comprises an orifice 32, 42 (FIG. 1B). In specified angular positions assumed by the first rotary device 3 and the second rotary device 4, the two orifices 32, 42 are aligned (FIG. 5) and form a groove able to cooperate with the hook-shaped head 51 of the pivoting lever 5. The insertion of the head 51 of the pivoting lever 5 in the groove thus formed causes a rocking of the lever 5 in the anticlockwise direction and a breaking of the breakable mechanical link. The breaking of the breakable mechanical link can of course be obtained by complementarity between different shapes of the orifices and of the hook-shaped head of the lever. For example, the orifices 32, 42 can be replaced by studs able to cooperate with a groove formed on the head of the lever 5. The orifice 42 of the second rotary device 4 is for example formed on a front disk 45 of the second rotary device 4 and can be seen in FIG. 1B. FIGS. 2C and 4C show the rear disk 44 of the second rotary device 4 upon which the stabilizer 7 is articulated.

The operation of the trip assistance device is illustrated in FIGS. 2A to 12B. In the appended figures, the position of the rotary lever M and therefore of the remote control device OD is indicated by the arrow f (FIG. 2A).

OFF Position—FIGS. 2A, 2B and 2C

In FIG. 2A, the rotary lever M of the circuit breaker D is in the off position and is horizontal. In this position, under the effect of the return spring 8, the free end of the first arm 60 of the pivoting part 6 bears against the protruding spur 530 of the retaining spring 53 (FIG. 2B) acting upon the lever 5 in the anticlockwise direction against the force applied by its torsion spring 50. The head 51 of the lever 5 thus comes to bear, for example, against the outer surface of the two rotary devices 3, 4. The stabilizer 7 is held at rest in its first position. The orifices 32, 42 formed on the first and second rotary devices 3, 4 are offset. FIG. 2C shows the rear part of the trip assistance device in the off position (OFF) and in particular the articulation of the stabilizer 7 on the rear disk 44 of the second rotary device 4 as well as the fixing of the ends of the spring, on the one hand on the second arm 61 of the pivoting part 6 and on the other hand on the free end opposite to that of the articulation 70 of the stabilizer 7.

Change from the OFF Position to the ON Position

Step 1—FIG. 3

In this case, the switching is carried out manually by the operator who operates the remote control device OD situated for example on the outside of the enclosure. The second rotary device 4 is therefore the driver as in the first operating mode described above. By the intermediary of the tenon 40, the second rotary device 4 therefore drives in rotation the first rotary device 3 towards the on position situated at 90° in the anticlockwise direction. The rotation of the pivoting part 6 being blocked by the bearing of its first arm against the spur 530 of the retaining spring 53, the rotation of the second rotary device 4 results in the lowering of the stabilizer 7 and therefore the extension of the return spring 8 stretched between the pivoting part 6 and the end of the stabilizer 7. The orifices 32, 34 of the two rotary devices 3, 4 are temporarily aligned at the start of the rotation towards the on position (ON). Under the effect of the return spring 8, the bearing of the pivoting part 6 against the retaining spring 53 results in a slight pivoting of the lever 5 in the anticlockwise direction such that the head 51 of the pivoting lever comes to bear against the two rotary devices 3, 4.

Step 2—FIG. 4A

On continuing the rotation of the remote control device OD a little beyond the on position (ON) (FIG. 4A), the second rotary device 4 continues its rotation until the outer protuberance 91 of the travel amplifying device 9 comes to butt against the casing 1, resulting in the rotation of this device 9 about its axis, in the clockwise direction, against the effect of its torsion spring 90. By the rotation of the travel amplifying device 9, the inner protuberance 92 pushes the first rotary device 3 in order to amplify its travel with respect to that of the second rotary device 4 and to angularly offset the two orifices 32, 34. In this way, the orifices 32, 34 of the first and second rotary devices 3, 4 are no longer aligned and they can thus move beyond the head 51 of the pivoting lever 5 without actuating the trip assistance device. The extension of the return spring 8 initiated in the preceding step continues until the dead point is passed and the stabilizer 7 has rocked into its second position.

Figure 4B:
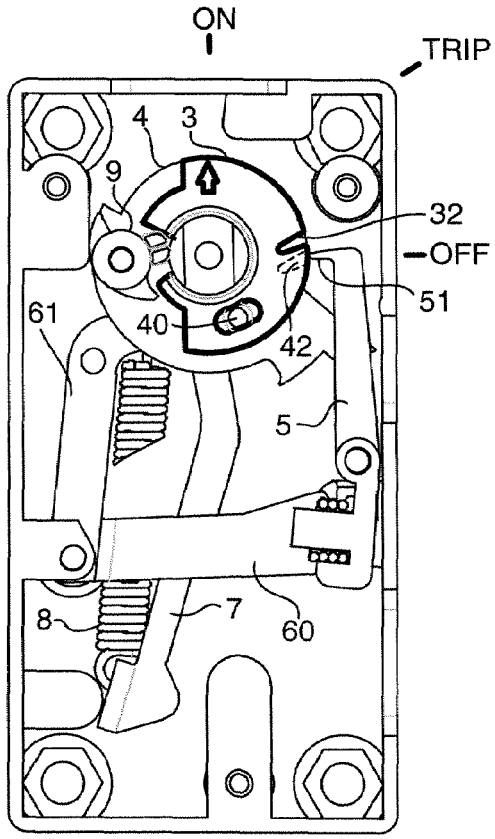
Figure 4C:
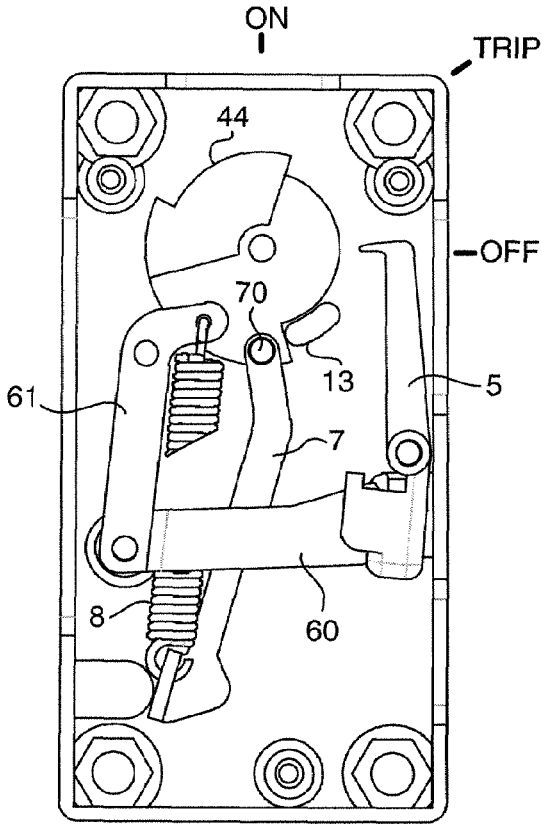

Step 3—FIGS. 4B et 4C

If the operator releases the remote control device OD, the latter returns exactly into the on position (ON), situated vertically (FIG. 4B). This position is perfectly stable and maintained due to the force applied by the return spring 8 which acts on the second rotary device 4 in the anticlockwise direction against a stop 13 formed on the casing 1 (FIG. 4C in which only the rear disk 44 of the second rotary device 4 is shown). The tenon 40 of the second rotary device 4 is then situated midway along the oblong orifice 30 of the first rotary device 3. In this stable position, the orifice 42 (shown in dotted line in FIG. 4B as it is not visible) of the second rotary device 4 is situated facing the head 51 of the lever, which is not the case for the orifice 32 of the first rotary device 3 which is still offset (FIG. 4B).

Change from the ON Position to the TRIPPED Position

Figure 5:
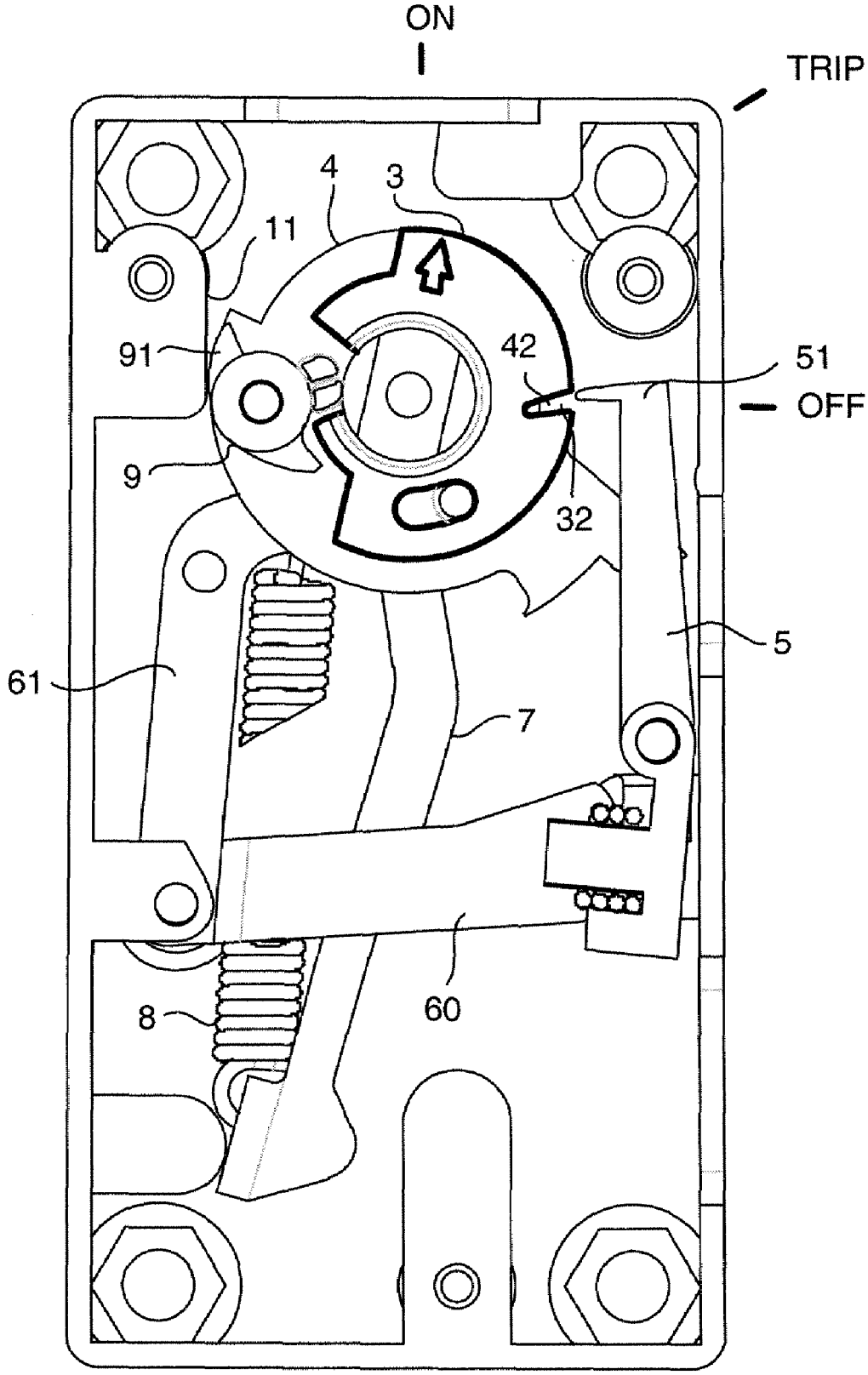

Step 1—FIG. 5

Following an electrical fault, the circuit breaker D changes to the tripped state. The rotary lever M of the circuit breaker D is therefore driven automatically towards its tripped position (TRIP) without action on the lever M nor on the remote control device OD. In this configuration, the lever M therefore has a driving effect and drives the remote control device OD. The trip assistance device therefore intervenes in this situation.

The rotation of the lever M of the circuit breaker D towards its tripped position (TRIP) results in the rotation of the first rotary device 3 until it butts against the tenon 40 of the second rotary device 4. In this stopped position, the two orifices 32, 42 are henceforth aligned and form the aforesaid groove (FIG. 5). The two orifices 32, 42 are then positioned facing the head 51 of the pivoting lever 5. The pivoting lever 5 being acted upon by the bearing of the pivoting part 6 at the level of the breakable mechanical link, its head 51 can enter the groove and allow a pivoting of the pivoting lever 5 in the anticlockwise direction (FIG. 6A).

Figure 6A:
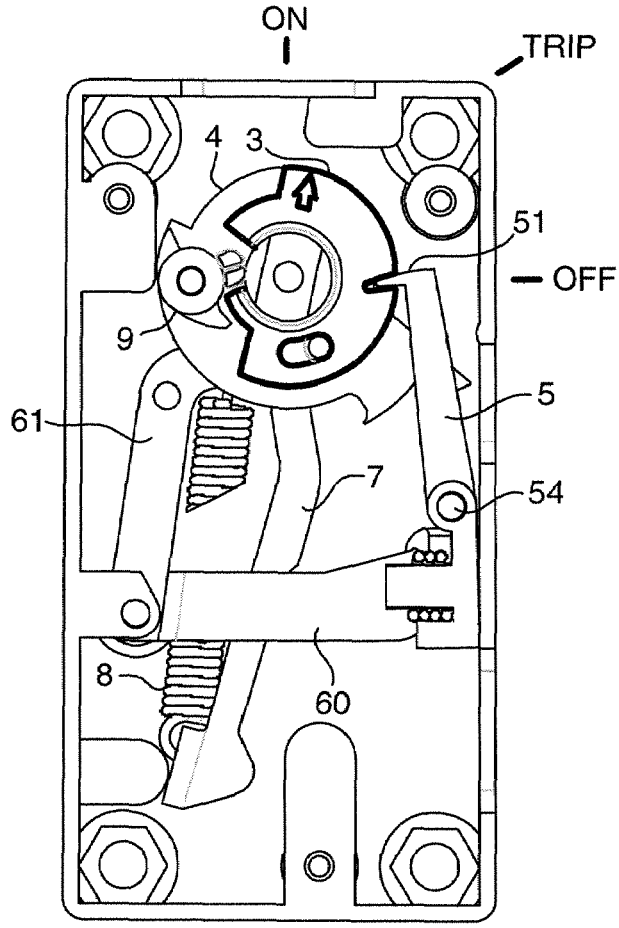
Figure 6B:
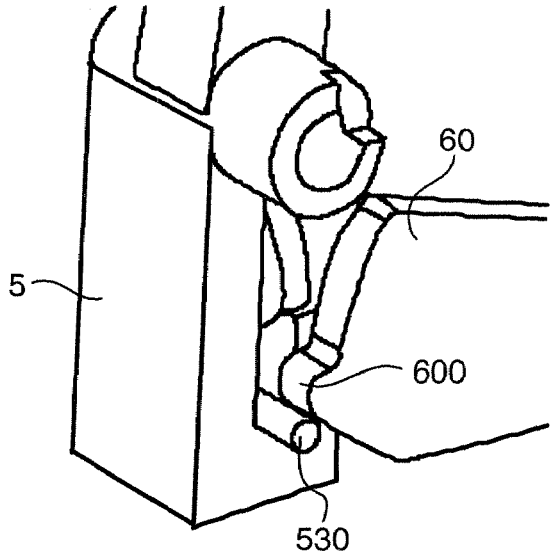

Steps 2, 3 and 4 are carried out very quickly and almost simultaneously whilst the two rotary devices are immobile with respect to each other:

Step 2—FIGS. 6A and 6B

The pivoting of the lever 5 and the insertion of its head 51 in the groove formed by the two aligned orifices 32, 42 results in a breaking of the breakable mechanical link established between the lever 5 and the pivoting part 6 (FIG. 6A). During the pivoting of the lever 5, the spur 530 of the retaining spring 53 retracts in front of the free end of the first arm 60 of the pivoting part 6, which releases the pivoting part 6 and the pivoting lever 5.

Figure 7A:
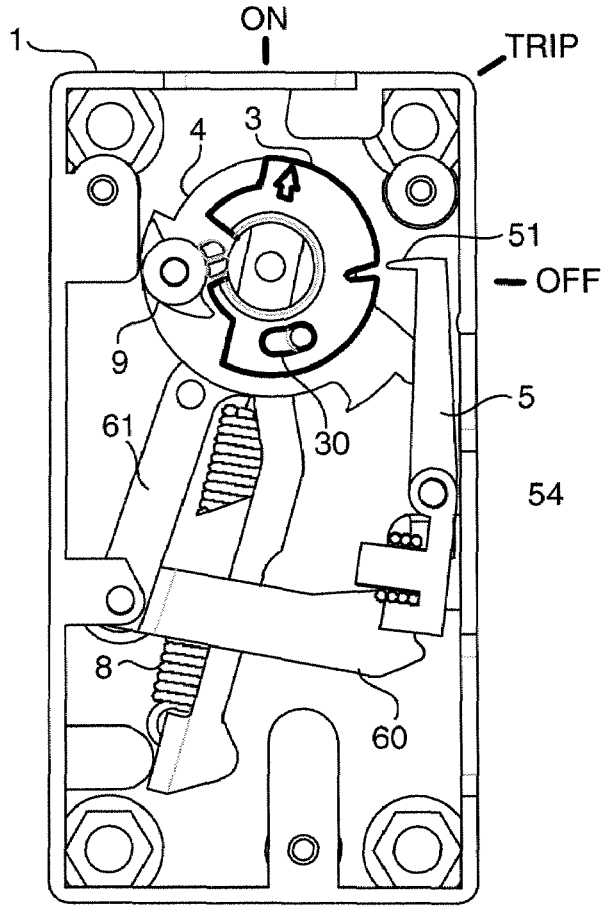
Figure 7B:
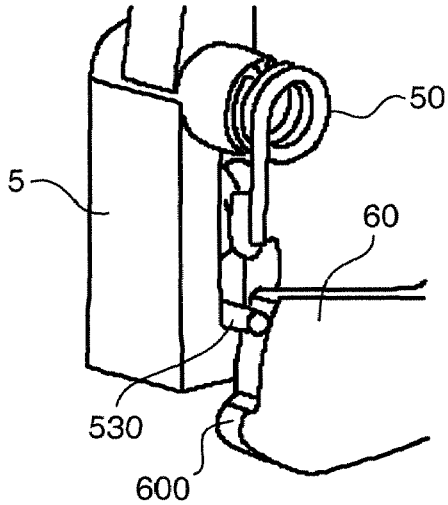

Step 3—FIGS. 7A and 7B

In this step the mechanical link between the pivoting lever 5 and the pivoting part 6 is broken. The pivoting part 6 acted upon by the return spring 8 pivots about its axis 62 in the clockwise direction. The released pivoting lever 5 is acted upon by its torsion spring 50 in order to return to the initial position, such that its head 51 disengages from the groove formed by the two orifices 32, 42.

During the rotation of the second rotary device 4, the axis of the stabilizer 7 again passes through the dead point. Simultaneously with the breaking of the breakable mechanical link, the stabilizer 7 again rocks towards its first position (FIG. 8).

Step 4—FIG. 8

The released pivoting part 6 continues its pivoting in the clockwise direction up to a stop 10 for example provided on the casing 1. The stabilizer 7 has rocked into its first position. The axis of the stabilizer 7 still being at the position of the dead point of the knuckle joint, the return spring 8 is acted upon to extend it between the free end of the second arm 61 of the pivoting part 6 and the end of the stabilizer 7 in order to store mechanical energy.

Step 5—FIG. 9

In this step, the return spring 8 releases the stored energy and contracts whilst drawing the stabilizer 7 and therefore the second rotary device 4 in rotation in the clockwise direction. The return spring 8 acts as a driver for the second rotary device 4 and therefore relieves the rotary device 3 in the driving of the transmission shaft A and the remote control device OD. The second rotary device 4 also drives the first rotary device 3 with a slight delay corresponding to the degree of freedom between these two parts, materialized by the length of the oblong hole 30. The shift between the rotation of the second rotary device 4 and the first rotary device 3 allows the travel amplifying device 9, which was until now held bearing against a stop 11 formed on the casing 1, to return to its initial position. Acted upon by its torsion spring 90, the travel amplifying device 9 pivots in the anticlockwise direction about its axis in order to regain its initial position of rest defined above.

Figure 10A:
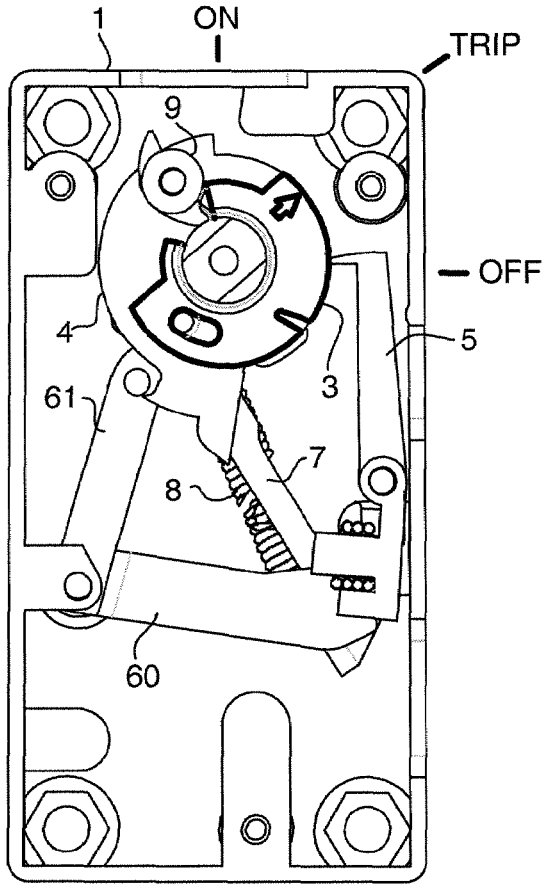
Figure 10B:
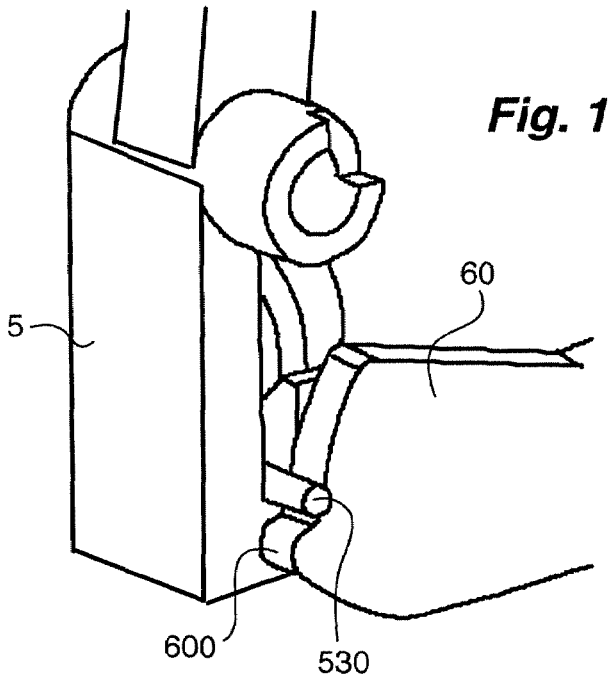

Step 6—FIGS. 10A et 10B

In this step a position of equilibrium is reached, this position corresponding to the tripped position of the lever M of the circuit breaker D. In this position of equilibrium, still under the action of the stabilizer 7 and of the return spring 8, the second rotary device 4 continues its rotation in the clockwise direction, resulting, by the intermediary of a hook 43 cooperating with a stud 63, in the rotation of the pivoting part 6 in the anticlockwise direction in order to make it rise again (FIG. 10A). The pivoting part 6 pivots until it comes to butt against the protruding spur 530 of the retaining spring 53, below the latter. In the position of equilibrium, the rotary lever M of the circuit breaker D and the remote control device OD are positioned at 45°, midway between the off position (OFF) and the on position (ON).

This position of equilibrium is maintained until the device is reinitialized.

Reinitialization of the device—Change from the TRIPPED Position to the OFF Position.

Figure 11A:
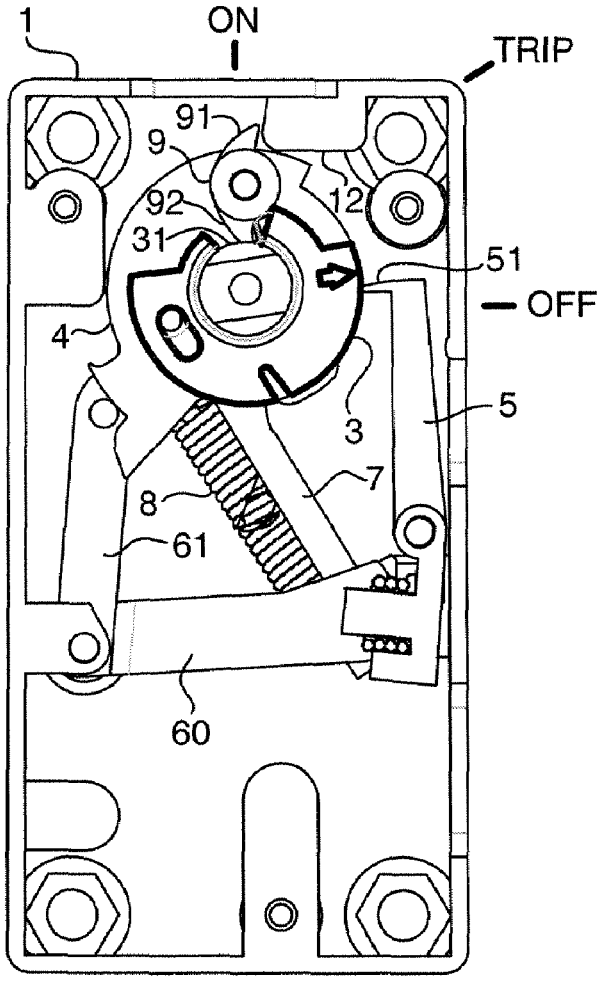
Figure 11B:
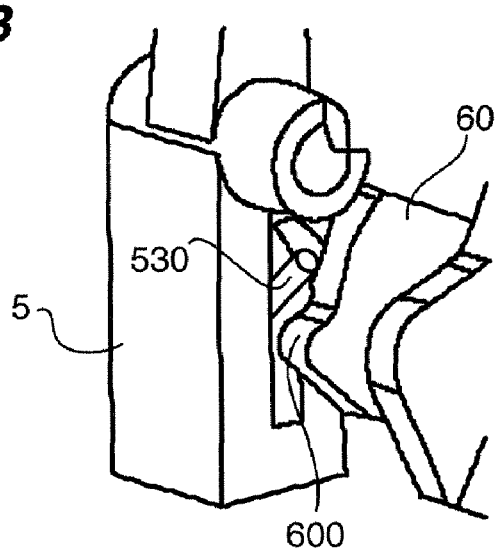

Step 1—FIGS. 11A and 11B

A circuit breaker D is reinitialized by turning the lever M in the clockwise direction beyond the off position (OFF) and then by releasing it so that it returns to the off position (OFF). This operation is carried out by the operator by actuating the remote control device OD which is therefore the driver in this operation. The reinitialization of the circuit breaker D must also be accompanied by the reinitialization of the trip assistance device.

In order to reinitialize the trip assistance device, it is a matter of making the first arm 60 pass again over the protruding spur 530 of the retaining spring 53 and reforming the breakable mechanical link.

In order to do this, the remote control device OD is turned in the clockwise direction by the operator, from the tripped position (TRIP) towards the off position (OFF) situated at 45°. The second rotary device 4 is therefore the driver and drives the first rotary device 3. The rotation of the second rotary device 4 causes the raising of the stabilizer 7 and of the return spring 8 which causes the pivoting of the pivoting part 6 in the anticlockwise direction until its free end retracts the protruding spur 530 of the retaining spring 53 in order to pass above (FIG. 11B).

Figure 12A:
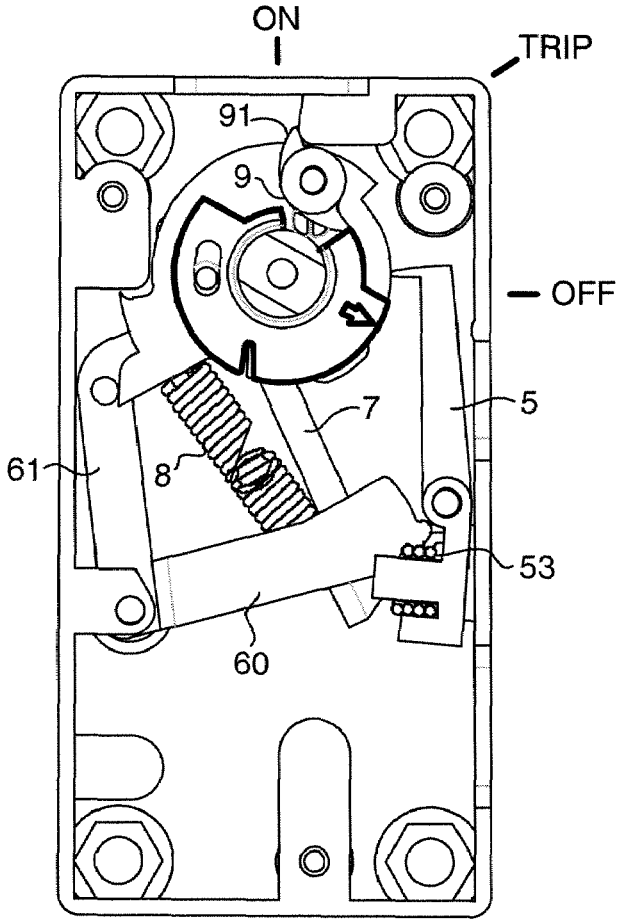
Figure 12B:
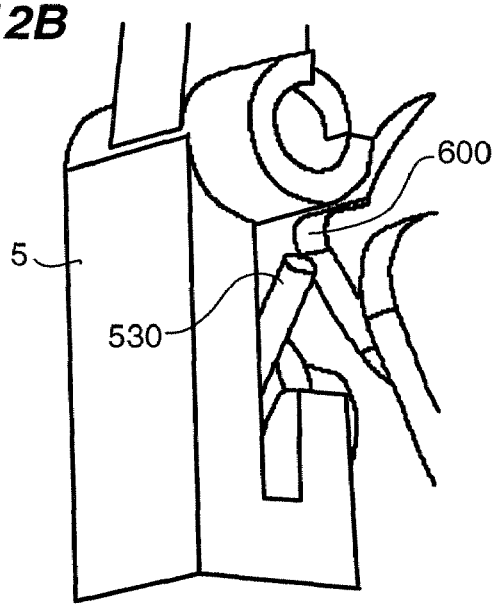

Step 2—FIGS. 12A et 12B

The rotation of the pivoting part 6 in the anticlockwise direction continues under the force applied by the operator which drives the lever M of the circuit breaker D beyond its off position by the intermediary of the remote control device. During the rotation of the second rotary device 4, the travel amplifying device 9 again comes to butt, by its outer protuberance 91, against a stop 12 formed on the casing 1, which causes its rotation in the anticlockwise direction. The inner protuberance 92 then pushes the first rotary device 3 which then drives the lever M of the circuit breaker D beyond the off position (OFF) and allows the reinitialization of the circuit breaker D. When the operator releases the remote control device OD, under the effect of the return spring 8 and of the stabilizer 7, the second rotary device 4 returns to the off position (OFF—FIG. 2A). The travel amplifying device 9 is returned to its initial position by its torsion spring 90. The pivoting part 6 again comes to rest on the protruding spur 530 of the spring 53 in order to again recreate the breakable mechanical link. The lever M and the remote control device OD are therefore again in the off position (OFF) (FIG. 2A).

The invention claimed is:

1. An extended actuating device for a circuit breaker, said device including a trip assistance mechanism comprising:

a body;

a first rotary device integral in rotation with a control lever of the circuit breaker, said lever configured to assume, by rotation about a principal axis, several offset angular positions, including an on position, an off position or a tripped position according to an on, an off or a tripped status of the circuit breaker;

a second rotary device integral in rotation with a remote control device, said second rotary device configured to assume several offset angular positions corresponding to the positions of the lever of the circuit breaker, said second rotary device being configured to be driven in rotation by the first rotary device as far as a first position corresponding to the tripped position of the lever of the circuit breaker;

a return spring configured to force the second rotary device towards said first position; and a breakable mechanical link configured to release the return spring when the breakable mechanical link is broken, the breakable mechanical link comprising a shape that is complementary to a shape of the first rotary device and to a shape of the second rotary device, the alignment of the shape of the breakable mechanical link and the shapes of the first and second rotary devices resulting in the breaking of the mechanical link.

2. The device according to claim 1, wherein the breakable mechanical link includes a pivoting part and a pivoting lever.

3. The device according to claim 2, wherein the pivoting lever has a pin against which the pivoting part forming the breakable mechanical link of the breakable mechanical link device bears.

4. The device according to claim 3, wherein the pin is constituted by a spur of a torsion spring mounted on the pivoting lever about an axis perpendicular to the principal axis.

5. The device according to one of claims 2 to 4, wherein the pivoting part comprises, on either side of its axis of rotation, two arms that are rigidly connected and angularly offset.

6. The device according to claim 5, wherein one of the arms of the pivoting part comprises a stop for the second rotary device when the latter is in its first position.

7. The device according to one of claims 2 to 4, wherein rotational force is applied to the pivoting lever by a torsion spring.

8. The device according to one of claims 2 to 4, further comprising:

a stabilizer articulated on an axis of articulation at a first end on the second rotary device, the axis of articulation being parallel with the principal axis and offset with respect to the latter.

9. The device according to claim 8, wherein the return spring is fixed on the pivoting part and on a second end of the stabilizer.

10. The device according to one of claims 2 to 4, wherein the pivoting lever includes a hook shaped head and in that the first rotary device and the second rotary device each comprise an orifice which, when the orifices are aligned, form a groove configured to receive the head of the pivoting lever.

11. The device according to one of claims 1 to 4, further comprising:

a travel amplifying device rotationally mounted on the second rotary device about an axis parallel with the principal axis and acted upon by a torsion spring, said travel amplifying device configured to cooperate with a stop of the body and with the first rotary device in order to amplify its travel.

12. The device according to claim 11, wherein the travel amplifying device comprises two radial protuberances, including an outer protuberance configured to butt against the body and an inner protuberance cooperating with a groove formed on the first rotary device.

13. The device according to one of claims 1 to 4, wherein the first rotary device and the second rotary device are integral in rotation, and have a degree of freedom with respect to each other.

* * * * *